United States Patent [19]

Dane

[11] Patent Number: 4,586,280

[45] Date of Patent: May 6, 1986

[54] NOVELTY ADVERTISING CAP

[76] Inventor: Brian Dane, 35891 Argonne, Newark, Calif. 94560

[21] Appl. No.: 705,080

[22] Filed: Feb. 25, 1985

[51] Int. Cl.[4] ..... G09F 3/00; G09F 19/00

[52] U.S. Cl. ..... 40/329; 40/406; 446/27; 446/176; 446/267; 446/483; 2/171; 2/185 R; 2/199

[58] Field of Search ..... 40/329, 406, 407, 412, 40/439, 440, 441; 2/171, 171.2, 209.1, 185 R, 195, 199, 175; 446/27, 267, 483, 176

[56] References Cited

U.S. PATENT DOCUMENTS

| | | | |
|---|---|---|---|
| 1,610,005 | 12/1926 | Haag | 446/483 |
| 2,059,602 | 11/1936 | Pflaum | 446/483 |
| 2,667,001 | 1/1954 | Sheridan | 40/406 |
| 2,705,751 | 4/1955 | Harris et al. | 40/329 |
| 2,797,526 | 7/1957 | Milhas, Jr. | 446/483 |
| 3,058,245 | 10/1962 | Pieters | 40/406 |
| 3,188,769 | 6/1965 | Parco | 446/267 |
| 3,253,354 | 5/1966 | Gollner et al. | 446/176 |
| 3,392,466 | 7/1968 | Giudice | 40/406 |
| 3,775,899 | 12/1973 | Wolf | 446/27 |
| 4,104,741 | 8/1978 | Shaw et al. | 2/185 R |
| 4,447,250 | 5/1984 | Wolens et al. | 2/199 |
| 4,488,316 | 12/1984 | Mosca | 2/185 R |
| 4,488,372 | 12/1984 | Lowen | 446/27 |

FOREIGN PATENT DOCUMENTS

| | | | |
|---|---|---|---|
| 871996 | 3/1953 | Fed. Rep. of Germany | 40/406 |
| 2390791 | 1/1979 | France | 40/406 |
| 983020 | 10/1962 | United Kingdom | 446/176 |

*Primary Examiner*—Gene Mancene
*Assistant Examiner*—James Hakomaki
*Attorney, Agent, or Firm*—Linval B. Castle

[57] ABSTRACT

A baseball-type cap having on the front and above the visor a miniature transparent mug which contains a small motor and pump that circulates a fluid from the bottom of the mug up through a conduit within the cap to a small dispensing tap mounted above the mug. The tap handle operates an electrical switch to power the motor and also a lamp that back-lights advertising material visable through the transparent mug and illuminates the fluid flowing through a transparent tube connected between the dispensing tap outlet and the bottom of the mug. A top cover of the mug may support a plastic foam for further realism.

12 Claims, 3 Drawing Figures

NOVELTY ADVERTISING CAP

BRIEF SUMMARY OF THE INVENTION

This invention relates generally to caps having advertising material thereon, and particularly to a novelty baseball-type cap supporting a miniature illuminated mug or beer stein with advertising material thereon and which appears to pour fluid from a fluid tap into the mug when the tap handle is opened.

Inexpensive baseball-type caps with advertising material either painted or sewn on the frontal area above the visor or brim of the cap are extremely popular and are handed out or sold by manufacturers or businesses as a very practical type of promotional material. It is apparent that the more striking or obvious the advertising material is upon a cap, the more it will be noticed by the public and will thus be better advertising.

The novelty baseball-type cap of the invention, being at normal eye level, is quickly noticed by everyone within view and provides an excellent advertising medium for any manufacturer or business dealing in a liquid comestible such as soft drinks, juices, beers, wines or the like.

Briefly described, the invention includes a conventional baseball-type cap normally used for product advertising. Mounted to the frontal area of the cap and above the brim is a small transparent receptacle such as a miniature mug which is formed with a semicircular front slot for receiving a plastic or paper sheet containing an emblem, tradename or mark, or other advertising material. Contained within the mug is a small 9 volt D.C. lamp for backlighting the advertising material and a miniature 9 volt pump which circulates a small supply of a suitably colored water through a closed system from an enclosed chamber in the bottom of the mug and up through a plastic tubing behind the front surface of the cap and through what appears to be a tap extending from the front surface and back down into the small fluid chamber in the bottom of the mug. The tap handle is an electrical switch which, when pivoted down to its "on" position, closes the circuit between a 9 volt battery and the electric pump and backlighting lamp so that the colored fluid being circulated by the pump will appear to be flowing from the tap into the transparent vessel.

The principal object of the invention therefore is to provide a baseball-type cap with an illuminated advertising display that will attract the greatest attention and provide better advertising value for an advertiser.

BRIEF DESCRIPTION OF THE DRAWINGS

In the drawings which illustrates the preferred embodiment of the invention.

DETAILED DESCRIPTION OF THE PREFERRED EMBODIMENT

Figure 1:
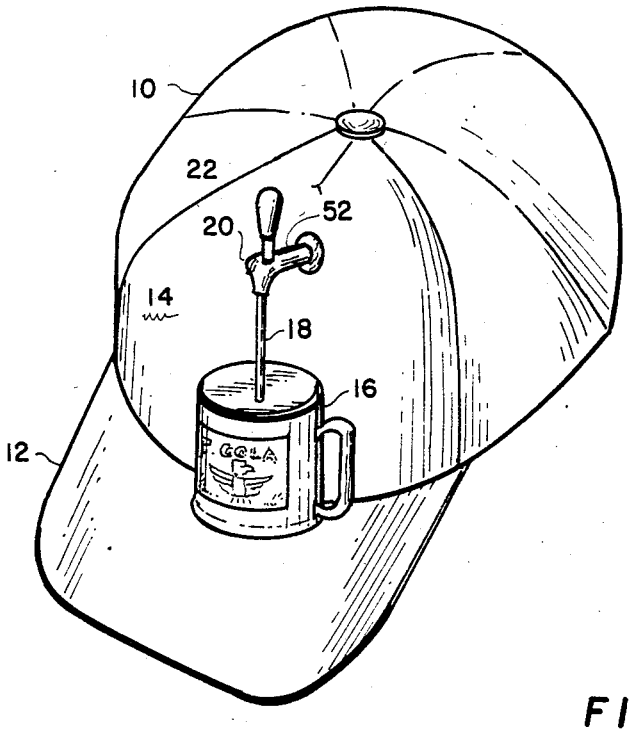
FIG. 1 is a perspective view illustrating my baseball-type advertising cap with miniature mug and its closed circuit fluid flow system.

FIG. 1 illustrates a typical baseball-type cap 10 with a front brim or bill 12 connected to the cap at a conventional vertical substantially flat section 14 of the cap that normally carries printed or sewn-on advertising material. Mounted to the flat section 14 and just above the visor 12 is a miniature plastic mug 16 having a diameter in the order of 1.5 inches and height approximately 2 inches. The mug is preferably formed of transparent plastic with a slot behind the transparent front face to accomodate a sheet containing advertising material, logo, tradename or trademarks of the advertiser, as will be subsequently described, and is connected by the clear plastic tube 18 to an apparent fluid tap 20 which is connected to the vertical cap section 14 so that it appears that the tap may receive a fluid from a source within the cap. The fluid tap 20 is illustrated with a typical beer or soda fountain type of tap handle 22, but other styles of tap handles, such as the rotary type used for wine barrel bung tap may be used.

Figure 2:
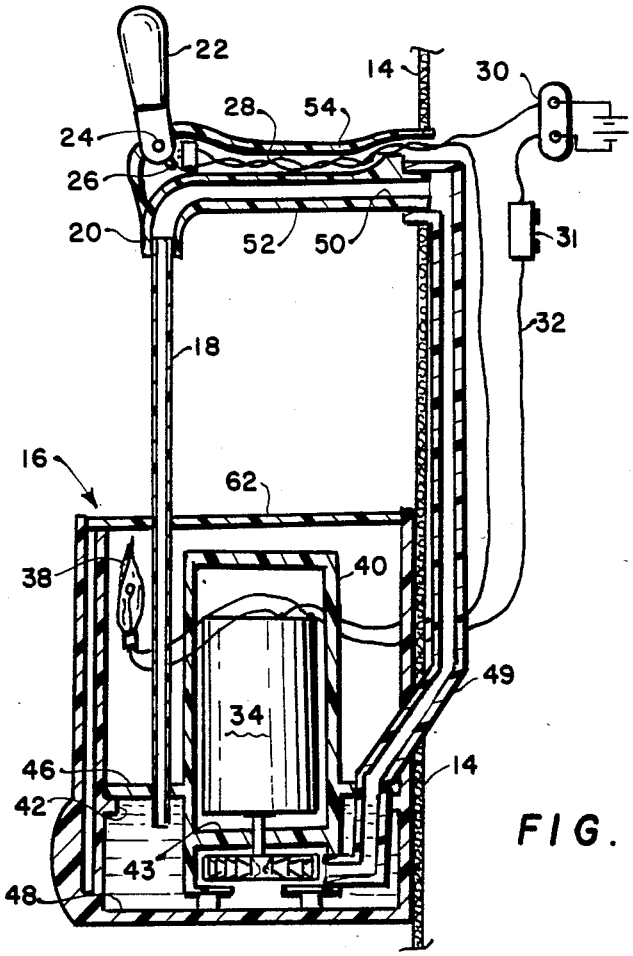
FIG. 2 is a side sectional view of the illuminated mug and closed circuit fluid flow system of FIG. 1.

As illustrated in the sectional side view of FIG. 2, the tap handle 22 is pivotable on a pin 24 and a portion of the lower part of the pivotable handle supports a small screw, the head 26 of which electrically short circuits the supported exposed ends of a small wire pair 28 to complete an electric circuit between a 9 volt battery which may be contained within the cap interior or which may be connected to terminals 30 to which battery leads may be coupled. If desired, the 9 volt battery power may be connected through a "flasher" 31, installed for a more striking visual effect, and thence though wires 32 inside the cap and through the vertical cap section 14 and rear wall of the plastic mug 16 to the 9 volt electric motor 34 of a small hobby-type pump 36 and also to a small lamp 38, Therefore, the pivoting forward of the tap handle 22 to its "on" position, will close the switch formed by the ends of the wire pair 28 and the 9 volt battery will turn on the pump motor 34 and light the lamp 38.

Figure 3:
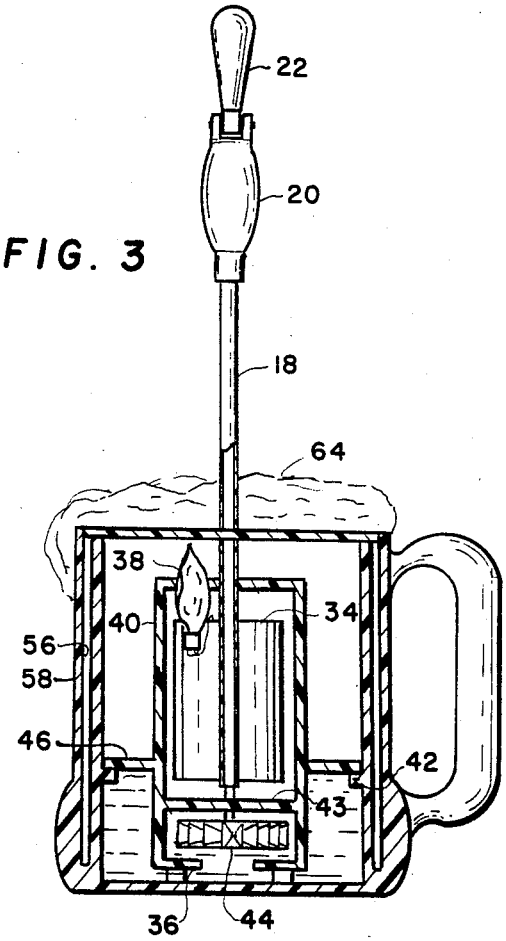
FIG. 3 is a sectional front view of the mug and fluid flow system.

As illustrated in FIGS. 2 and 3 the pump motor 34 is contained within a tubular housing 40 having a circular floor 43 having a small opening for the motor shaft which is connected to the pump impeller 44 within its chamber. A flange 46 is circumferentially connected to the exterior surface of the tubular housing 40 and its exterior portion rests upon and is cemented to an annular ring 42 in the interior wall of the mug 16. The chamber formed between the lower surface of the flange 46 and the mug interior floor 48 serves as a fluid reservoir through which the fluid in the system circulates. The motor is thus firmly attached to the mug out of the fluid containing reservoir while the pump is immersed within the fluid with the reservoir.

As best illustrated in FIG. 2, the fluid pump 36 is coupled to a soft plastic tube 49 which preferably passes through the flange 46 and out through the rear wall of the mug and the cap section 14 and up within the cap to a connection with a fluid passage 50 in the tap's stem 52 which is attached to the face of the cap section 14. It will be noted that the wire pair 28 are also within the stem 52, but within a separate "dry" passage 54 for preventing moisture from causing an unwanted short circuit of the wires.

The transparent plastic tube 18 is connected between the end of the tap 20 and the reservoir formed in the mug 16 between the flange 46 and the mug floor 48. Thus, operation of the pump 36 will cause the fluid within the reservoir to flow through the tube 49, the tap 20, and down the transparent tube 18 illuminated by the lamp 38 and back into the reservoir.

The mug 16 is formed with double walls in the front and sides, as shown in FIGS. 2 and 3, with the top end of the inner wall slightly below the level of the outer wall 60 and supporting a plastic top cap 62 for enclosing the interior of the mug 16. The thin slot 56 separating the transparent outer walls 58 and 60, respectively, permits a thin sheet of advertising material to be inserted and backlighted by the lamp 38 when illuminated concurrently with the operation of the fluid pump. Therefore, when the fluid pump is started, the fluid flows from the tap 20 into the mug 16, the transparent fluid in the tube 18 becomes illuminated to appear as a free flowing column of fluid, and the advertising material in the slot 56 is also illuminated.

For added realism, "foam" 64 in the form of white plastic wool or foam may be cemented to the mug top cap fluid when the cap advertises a beer or other foaming liquid, as illustrated in FIG. 3.

Having thus described by invention, what I claim is:

1. In combination with a cap having a brim and a substantially vertical frontal section above said brim, an advertising novelty comprising:

a fluid receptacle attached to the frontal section of the cap, said receptacle having a transparent frontal portion for displaying a sheet of advertising material located behind said frontal portion;

a fluid tap having a fluid inlet and outlet, said tap attached to said cap frontal section and positioned above above said receptacle, said tap having a tap handle which, when turned from an "off" position to an "on" position, closes an electrical switch within the body of said tap;

a transparent tube extending from the fluid outlet of said tap into said receptacle;

electrical pumping means within said receptacle;

a fluid conduit coupled between said pumping means and the inlet of said fluid tap; and an source of electricity coupled through said electrical switch to said electrical pumping means for energizing said pumping means for circulating fluid from said receptacle through said fluid conduit, said fluid tap and said transparent tubing and into said receptacle.

2. The advertising novelty claimed in claim 1 further including a light bulb located within said receptacle and above the level of fluid therein, said bulb being coupled to said source of electricity for illuminating said transparent tube and the interior of said receptacle behind the transparent frontal portion thereof.

3. The advertising novelty claimed in claim 2 wherein said fluid conduit passes from said pumping means through a first opening in said receptacle and said substantially vertical frontal section and extends up within said cap and behind said vertical frontal section to pass through a second opening in said frontal section to said fluid tap inlet.

4. The advertising novelty claimed in claim 3 wherein said electrical pumping means includes a D.C. motor having a rotatable shaft coupled to a pump impeller located below said motor and within a reservoir formed between the bottom surface of said receptacle and the bottom surface of a chamber in said receptacle that encloses said motor.

5. The advertising novelty claimed in claim 4 wherein said motor enclosing chamber is supported at a predetermined vertical position within said receptacle by a substantially horizontal circular flange surrounding said chamber and connected thereto and an annular ring on the inner surface of said receptacle, and wherein said transparent tube extends from the fluid outlet of said tap and through said flange for circulating fluid into the volume below said flange and into said reservoir.

6. The advertising novelty claimed in claim 5 wherein said source of electricity is a battery located within said cap and wherein said battery is coupled through a dry conduit associated with said fluid tap to said electrical switch within the body of said tap.

7. The advertising novelty claimed in claim 6 further including a flasher element in the electrical coupling to said pump motor and to said light bulb for the intermittent operation of said bulb and said pump motor while said electrical switch is closed.

8. The advertising novelty claimed in claim 7 wherein said fluid tap handle pivots between "off" and "on" positions, and wherein an arcuate portion on a pivoting portion of said tap handle contains an electrically conductive protrusion that contacts both conductors of an electrical wire pair within said dry conduit for closing said electrical switch.

9. The advertising novelty claimed in claim 1 wherein at least the frontal section of said cap is transparent to translucent and wherein said section of formed with inner and outer walls that are separated to form a slot therebetween, said slot providing an area for inserting sheets of advertising material.

10. The advertising novelty claimed in claim 8 wherein at least the frontal section of said cap is transparent to translucent and wherein said section of formed with inner and outer walls that are separated to form a slot therebetween, said slot providing an area for inserting sheets of advertising material.

11. The advertising novelty claimed in claim 1 further including a top cover for said receptacle, said top cover being covered with a material representing foam.

12. The advertising novelty claimed in claim 8 further including a top cover for said receptacle, said top cover being covered with a material representing foam.

* * * * *